US010953261B2

(12) United States Patent
Hernandez

(10) Patent No.: US 10,953,261 B2
(45) Date of Patent: Mar. 23, 2021

(54) SHOE WEIGHT FOR ATHLETIC TRAINING

(71) Applicant: Mark Hernandez, Las Vegas, NV (US)

(72) Inventor: Mark Hernandez, Las Vegas, NV (US)

( * ) Notice: Subject to any disclaimer, the term of this patent is extended or adjusted under 35 U.S.C. 154(b) by 114 days.

(21) Appl. No.: 15/993,140

(22) Filed: May 30, 2018

(65) Prior Publication Data

US 2018/0345065 A1 Dec. 6, 2018

Related U.S. Application Data

(60) Provisional application No. 62/513,522, filed on Jun. 1, 2017.

(51) Int. Cl.

| | |
|---|---|
| ***A63B 21/065*** | (2006.01) |
| ***A63B 21/00*** | (2006.01) |
| ***A63B 23/04*** | (2006.01) |
| ***A63B 1/00*** | (2006.01) |
| *A43B 5/00* | (2006.01) |

(52) U.S. Cl.

CPC ..... *A63B 21/065* (2013.01); *A63B 1/00* (2013.01); *A63B 21/0004* (2013.01); *A63B 21/4043* (2015.10); *A63B 23/0405* (2013.01); *A43B 5/00* (2013.01); *A63B 2225/09* (2013.01)

(58) Field of Classification Search

CPC ... A63B 21/065; A63B 21/4015; A63B 23/04; A63B 23/10; A43B 3/0047; A43B 3/0031; A43B 3/18; A43B 11/00; A43B 5/18; A43B 19/005; A43C 1/006; A43C 11/06; A43C 11/004

USPC ..... 36/132, 105

See application file for complete search history.

(56) References Cited

U.S. PATENT DOCUMENTS

| | | | | | |
|---|---|---|---|---|---|
| 2,214,052 | A | | 9/1940 | Good | |
| 3,306,610 | A | * | 2/1967 | Biggs, Jr. | A43B 3/0031 482/105 |
| 3,406,968 | A | * | 10/1968 | Gussie | A43B 19/005 482/105 |
| 3,517,928 | A | | 6/1970 | Shanahan | |
| 4,958,447 | A | * | 9/1990 | Dupree | A43B 3/242 36/100 |
| 5,231,776 | A | | 8/1993 | Wagner | |
| 5,728,032 | A | * | 3/1998 | Glass | A43B 5/00 36/132 |
| 5,893,223 | A | * | 4/1999 | Glass | A43B 5/00 36/132 |

(Continued)

*Primary Examiner* — Jennifer Robertson
*Assistant Examiner* — Catrina A Letterman
(74) *Attorney, Agent, or Firm* — Boudwin Intellectual Property; Daniel Boudwin

(57) ABSTRACT

A shoe weight for athletic training including a shoe sleeve configured to rest upon the outer surface of a shoe while being worn. A U-shaped member is disposed within the shoe sleeve and designed to exert an inward force against the outer surface of the shoe being worn. A lace clip having an upper portion a lower portion, and a point of inflection is also disposed within the sleeve, such that the lower portion of the lace clip can slide in between the laces and the tongue of the shoe while the point of inflection and the upper portion hook the sleeve to the shoe. The shoe weight further includes a plurality of weights disposed within the shoe sleeve, such that the wearer of the shoe is forced to expend greater energy while walking, running, or performing any act involving movement of the foot inserted in the shoe being worn.

11 Claims, 8 Drawing Sheets

(56) References Cited

U.S. PATENT DOCUMENTS

| | | | | |
|---|---|---|---|---|
| 6,010,438 | A * | 1/2000 | Fitzgerald | A63B 21/065 36/132 |
| 6,594,921 | B2 * | 7/2003 | Laio | A43B 3/24 36/105 |
| 2003/0192198 | A1 * | 10/2003 | Wright | A43B 1/0081 36/7.7 |
| 2004/0074113 | A1 * | 4/2004 | Kim | A43B 5/185 36/135 |
| 2005/0235522 | A1 * | 10/2005 | Crowley, II | A43B 3/242 36/2 R |
| 2005/0252042 | A1 * | 11/2005 | Harrington | A43B 5/00 36/132 |
| 2010/0050477 | A1 | 3/2010 | Zeek | |
| 2012/0011750 | A1 * | 1/2012 | Kann | A43B 3/18 36/72 R |
| 2015/0143717 | A1 * | 5/2015 | Billings | A43C 7/005 36/83 |
| 2016/0029742 | A1 * | 2/2016 | Cifo Garcia | A63B 21/4025 36/132 |
| 2016/0345656 | A1 * | 12/2016 | Ramirez, II | A43B 5/18 |
| 2017/0028244 | A1 * | 2/2017 | Schreiber | A63B 21/0557 |

* cited by examiner

SHOE WEIGHT FOR ATHLETIC TRAINING

CROSS REFERENCE TO RELATED APPLICATION

This application claims the benefit of U.S. Provisional Application No. 62/513,522 filed on Jun. 1, 2017. The above identified patent application is herein incorporated by reference in its entirety to provide continuity of disclosure.

BACKGROUND OF THE INVENTION

The present invention relates to weight training a general fitness. More specifically, the present invention provides a shoe weight for athletic training.

Many people exercise by using weighted clothing or wrist and ankle weights in order to increase speed and agility. However, traditional ankle weights are cumbersome, leading to frustrating and difficult training regimens as the user must account for the bulkiness of the ankle weight. Additionally, traditional ankle weights are uncomfortable to wear and are known to increase the risk of injury or pain in the ankle when used. The present invention provides a shoe weight that increases the amount of effort required when walking, running, or performing any act involving movement of the feet without unwanted bulkiness, or discomfort, and a reduced risk of pain or injury to the ankle.

Devices have been disclosed in the known art that relate to shoe weights for athletic trailing. These include devices that have been patented and published in patent application publications. These devices generally relate to weighted athletic shoes that are designed to increase the intensity of a regular exercise regimen. However, these devices do not include a U-shaped member or a lace clip, both of which are designed to increase the stability of the weight when worn on the shoe.

In light of the devices disclosed in the known art, it is submitted that the present invention substantially diverges in design elements from the known art and consequently it is clear that there is a need the art for an improvement to existing shoe weights for athletic training. In this regard the instant invention substantially fulfills these needs.

SUMMARY OF THE INVENTION

In view of the foregoing disadvantages inherent in the known types of shoe weight for athletic training now present in the known art, the present invention provides a new shoe weight for athletic training wherein the same can be utilized for providing convenience for the user when exercising with weighted shoes.

It is therefore an object of the present invention to provide a new and improved shoe weight for athletic training that has all of the advantages of the known art and none of the disadvantages.

It is another object of the present invention to provide a shoe sleeve having a left side, a right side, a front end, and a top end, configured to rest upon the outer surface of a shoe while being worn.

Another object of the present invention is to provide a flexible U-shaped member disposed within the shoe sleeve configured to exert an inward force against the outer surface of the shoe being-worn, such that the sleeve is held in place against the surface of the shoe.

A further object of the present invention to provide a lace clip having an upper portion, a lower portion, and a point of inflexion, such that the lower portion of the lace cap is configured to slide in between the laces and the tongue of the shoe to further secure the sleeve to the outer surface of the shoe.

An additional object of the present invention is to provide a plurality of weights disposed within the shoe sleeve, such that the wearer of the shoe is forced to expend greater energy, while walking, running, or performing any act involving movement of the foot inserted in the shoe being worn.

Yet another object of the present invention is to provide a shoe sleeve including a first compartment disposed on the left side configured to receive and house a first weight therein, a second compartment disposed on the right side configured to receive and house a second weight therein, and a third compartment disposed on the front end configured to receive and house a third weight therein.

Another object of the present invention is to provide an adjustable strap configured to vary the size of the aperture.

A further object of the present invention is to provide a shoe weight for athletic training that may be readily fabricated from cost effective materials that are durable.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1A shows a perspective view of an embodiment of a shoe weight for athletic training, as worn on a shoe.

FIG. 1B snows a perspective view of an embodiment of a shoe weight for athletic training, worn on a shoe.

DETAILED DESCRIPTION OF THE INVENTION

Figure 1A:
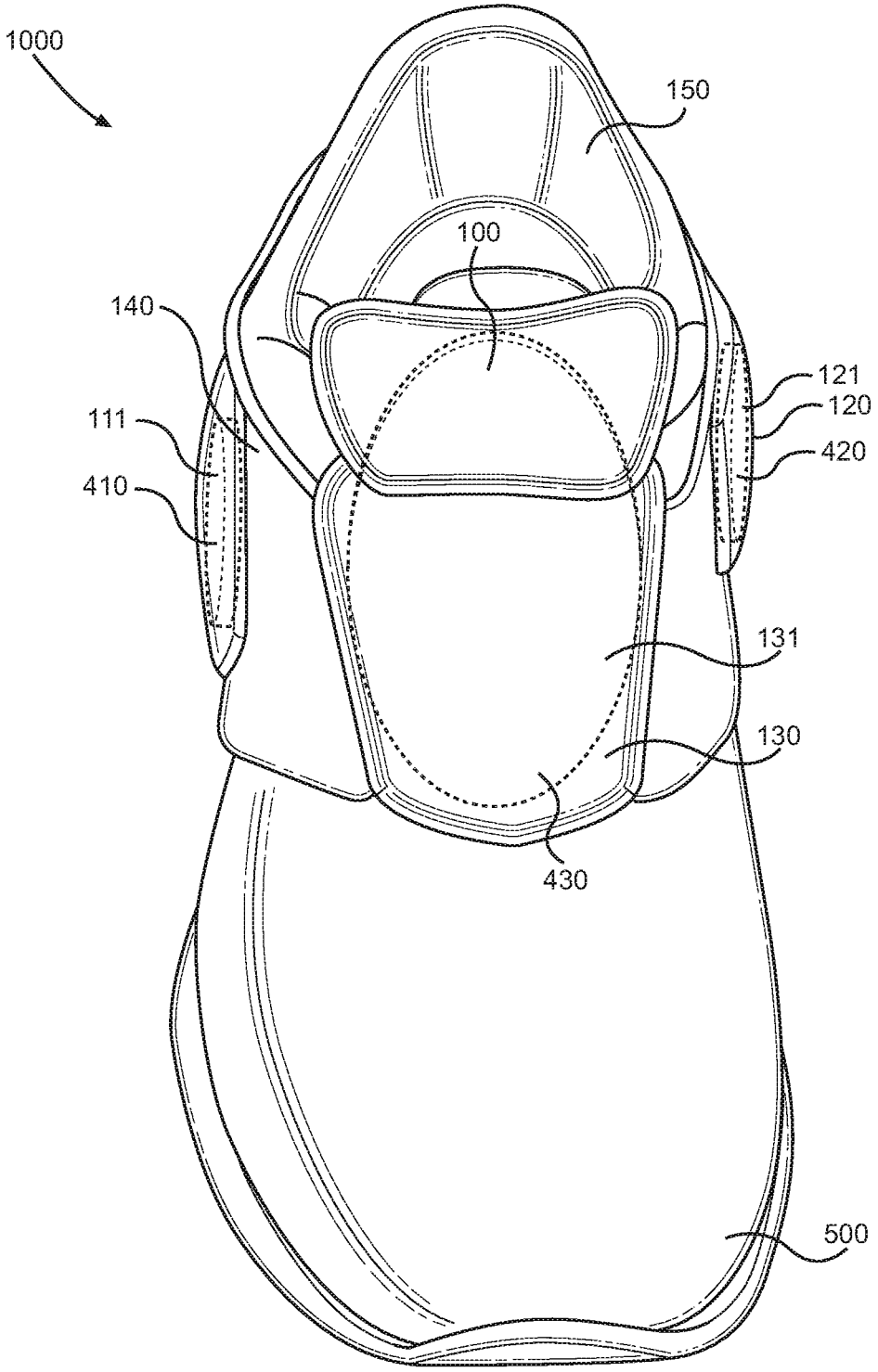
FIG. 1C shows a cross-sectional view along line 1C of an embodiment of a shoe weight for athletic training, as worn on a shoe.

Reference is made herein to the attached drawings. Life reference numerals are used throughout the drawings to depict like or similar elements of the shoe weight for athletic training. For the purposes of presenting a brief and clear description of the present invention, the preferred embodiment will be discussed as used for the shoe weight for athletic training. The figures are intended for representative purposes only and should not be considered to be limiting in any respect.

Figure 1B:
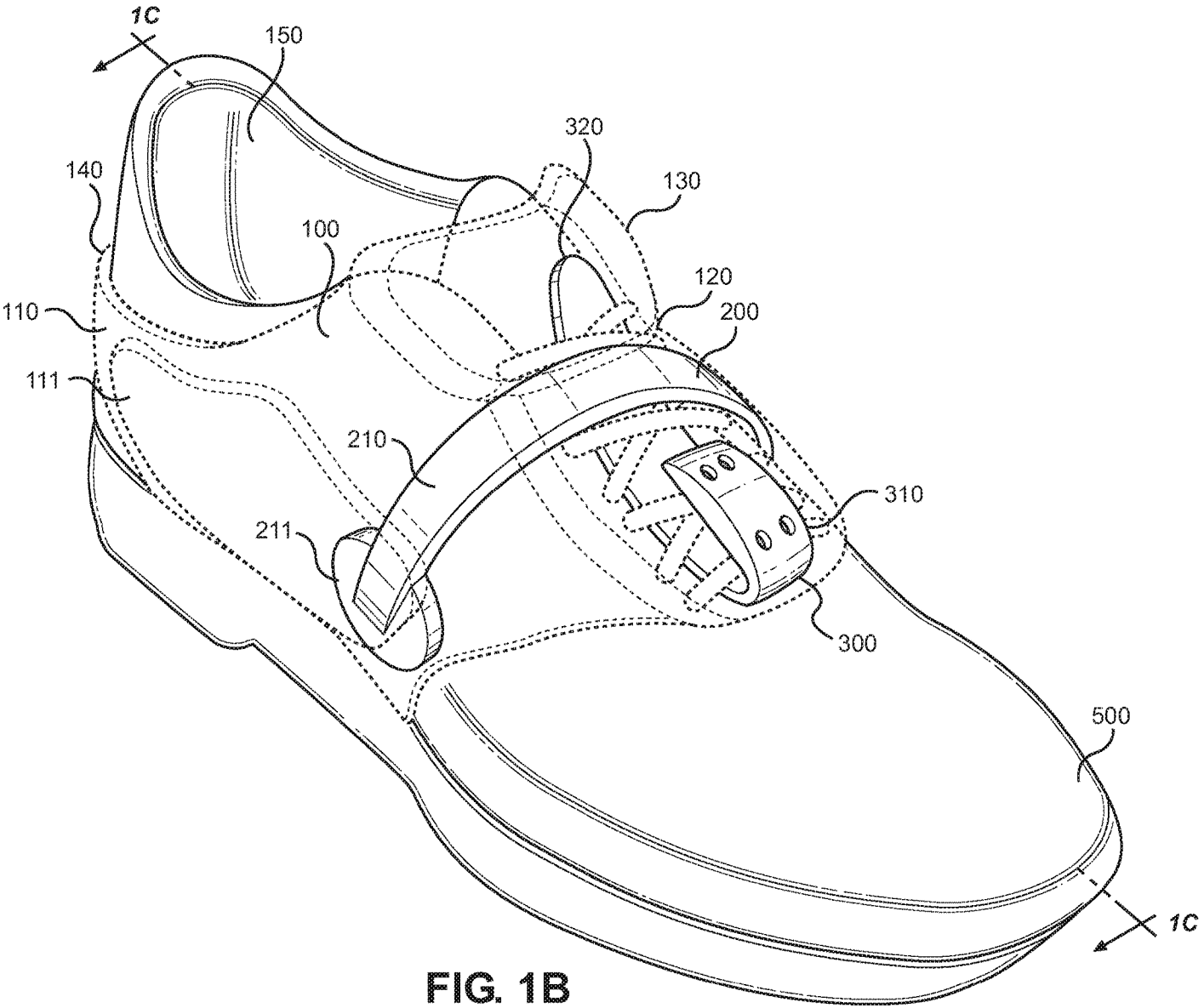
Figure 1C:
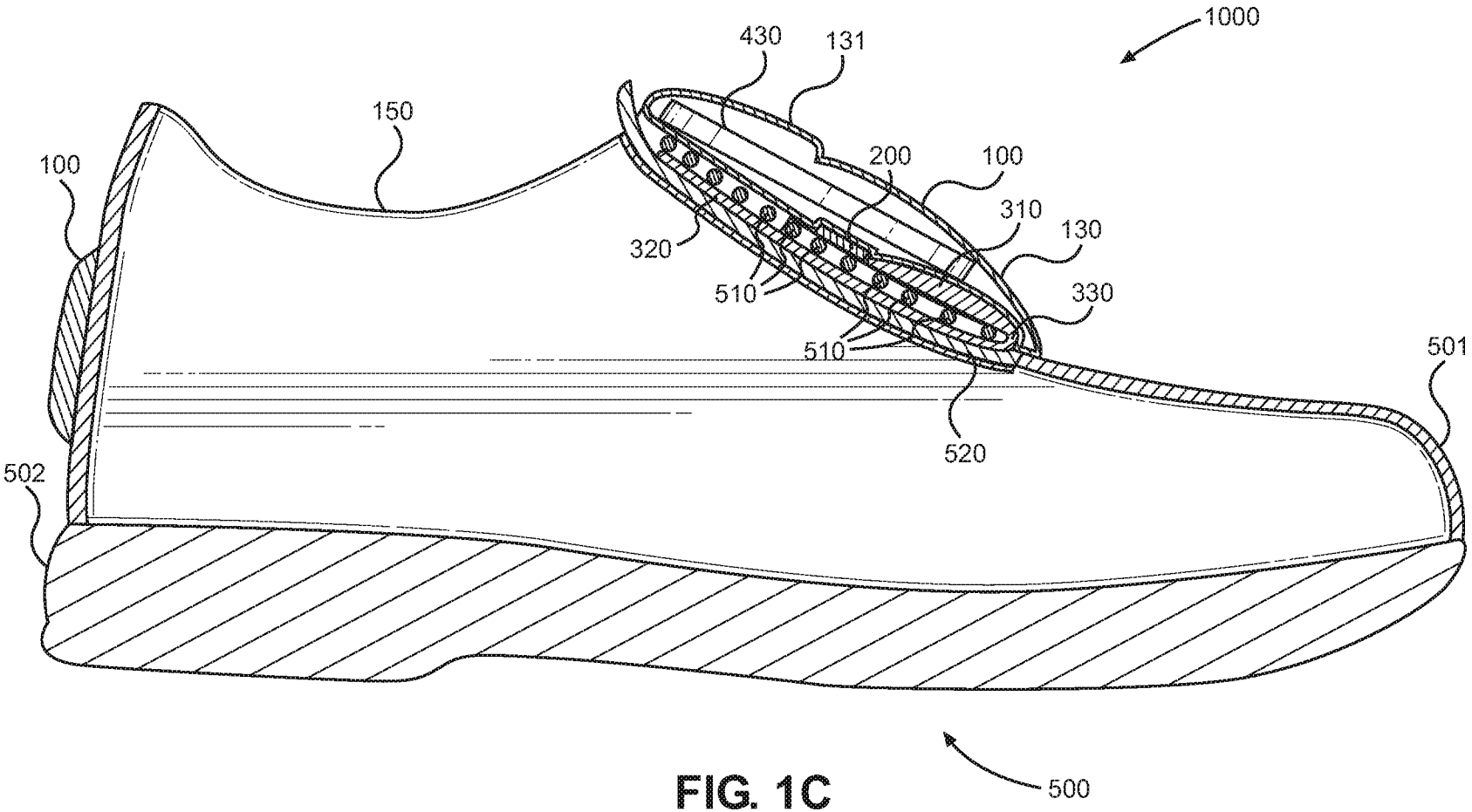

Referring now to FIGS. 1A, 1B, and 1C, there are shown perspective views and a cross-sectional view along line 1C of an embodiment of a shoe weight for athletic training, as worn on a shoe, respectively. The removeable shoe weight 1000 for athletic training, comprises a shoe sleeve 100 having a left side 110, a right side 120, a front end 130, and a top end 140, configured to rest upon the outer surface of a shoe 500 while being worn. In the illustrated embodiment, the shoe sleeve 100 further includes a first compartment 111 disposed on the left side 110 configured to receive and permanently secure a first weight 410 therein, a second compartment 121 disposed on the right side 120 configured to receive and permanently secure a second weight 420 therein, and a third compartment 131 disposed on the front end 130 configured to receive and permanently secure a third weight 430 therein. The weights 410, 420, 430 are disposed within the shoe sleeve 100, such that the wearer of the shoe 500 is forced to expend greater energy while walking, running, or performing any act involving movement of the foot inserted in the shoe 500 being worn. In an alternate embodiment, the first, second, and third compartments 111, 121, 131 are all configured to facilitate removeable insertion of the first, second, and third weights 410, 420, 430, such that when in use a person can vary the load in the sleeve to either increase or decrease the intensity of the workout.

The top end 140 of the sleeve 100 includes an aperture 150 sized and proportioned for a foot to pass through and insert itself into the shoe 500 being worn under the sleeve 100. A flexible U-shaped member 200 is disposed within the shoe sleeve 100, such that the U-shaped member is positioned over the laces of the shoe 500 and exerts an inward force to grip the outer surface of the shoe 500 being worn and ensure that the shoe sleeve 100 is held in place. A lace clip 300 having an upper portion 310, a lower portion 320, and a point of inflexion 330 is also disposed within the sleeve 100 and configured to further secure the shoe sleeve 100 to the shoe 500. The lower portion 320 of the lace clip 300 is sized and proportioned to slide in between the laces 510 and the tongue 520 of the shoe 500 from the toe-side 501 toward the heel-side 502 such that the point of inflection 330 and the upper portion 310 hook the sleeve 100 to the shoe 500.

Figure 2:
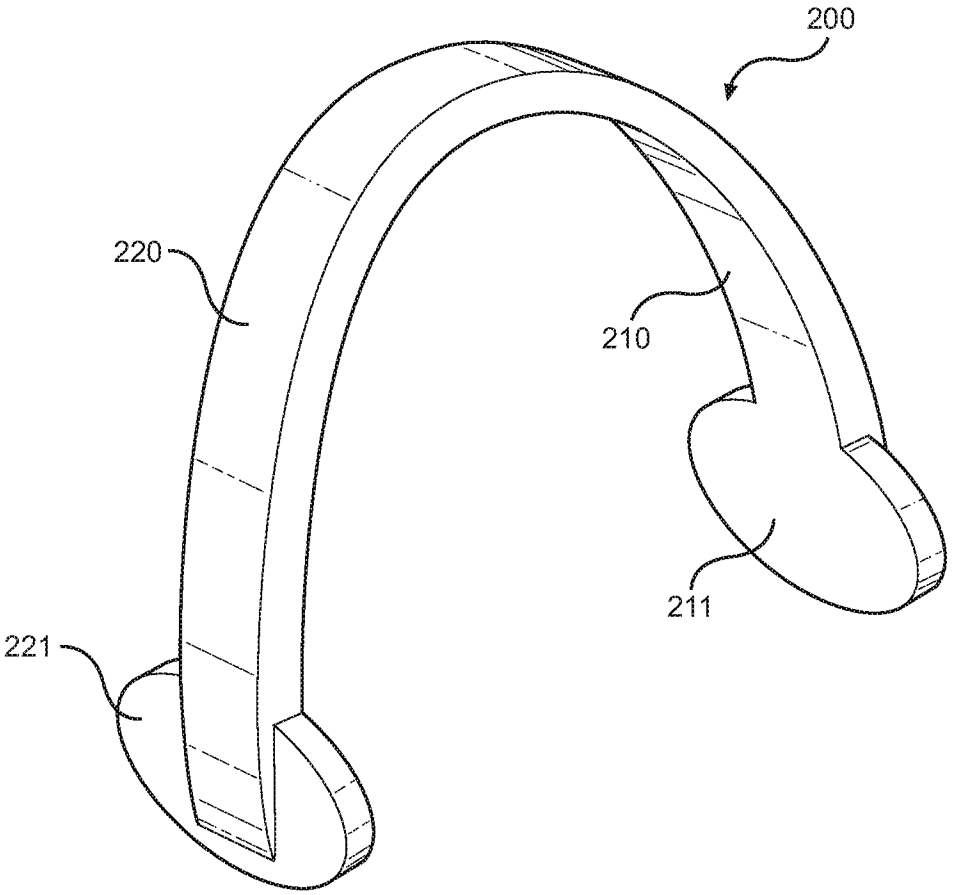
FIG. 2 shows a close-up perspective view of a U-shaped member in an embodiment of a shoe weight for athletic training.

Referring now to FIG. 2, there is shown a perspective view of a U-shaped member in an embodiment of a shoe weight for athletic training. In the illustrated embodiment the U-shaped member 200 includes a left arm 210 and a right arm 220, such that the left arm 210 is configured to press against the left side of the shoe being worn, and right arm 220 is configured to press against the right side of the shoe being worn. Additionally, a first pressure pad 211 is disposed on the end of the left arm 210 of the U-shaped member 200, and a second pressure pad 221 is disposed on the end of the right arm 220 of the U-shaped member 200. In the illustrated embodiment the pressure pads 211, 221 are oval in shape to increase the amount of surface area that they can cover through the sleeve on the shoe being worn underneath. Alternate embodiments can include pressure pads in the other standard shapes, or a customized shape configured to maximize surface area available within compartments on the left and right side of the shoe. When in use the inward force exerted by each arm 210, 220 of the flexible U-shaped member 200 is further distributed across the surface area of the pressure pads 211, 221 in order to increase the stability of the shoe weight on the shoe. To maximize the inward force gripping the shoe 500, the U-shaped member 200 must be disposed within the sleeve closer to the heel-side 502 than to the toe-side 501 of the shoe 500 such that the arms 210, 220 cover the laces 510.

Figure 3:
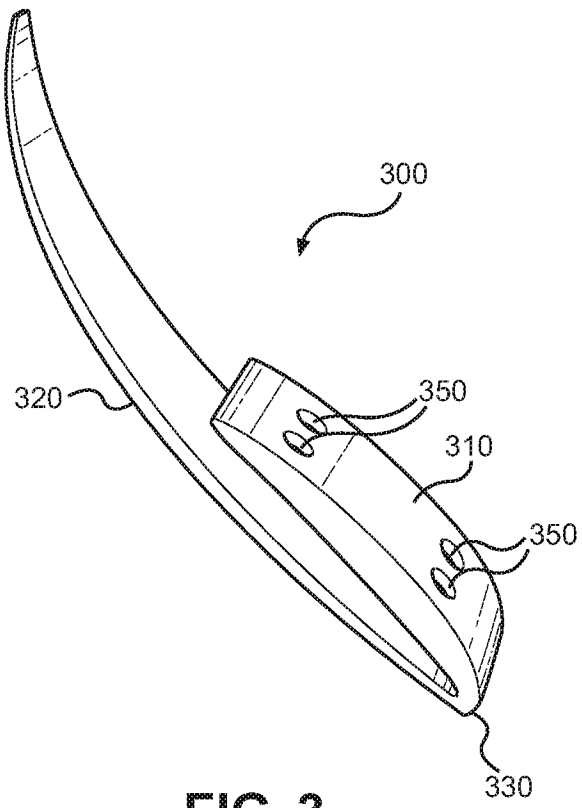
FIG. 3 shows a close-up perspective view of a lace clip in an embodiment of a shoe weight for athletic training.

Referring now to FIG. 3, there is shown a perspective view of a lace clip in an embodiment of a shoe weight for athletic training. In the illustrated embodiment, the upper portion 310 of the lace clip 300 includes a plurality of apertures configured to allow stitch work therethrough to permanently secure the lace clip 300 to the shoe sleeve. The lace clip 300 is used to interconnect the sleeve to the shoe by sliding the lower portion 320 under the laces of a shoe. As such, the lower portion 320 must protrude out of the sleeve in order to interact with the laces, while the upper portion 310 is firmly embedded into the fabric of the sleeve.

Attaching the lace clip 300 to the sleeve by sewing through the apertures 350 is both an effective and affordable method of ensuring that the sleeve and the weights therein are stably secured, and to prevent the sleeve from moving around on the surface of the shoe when in use. In other embodiments, the stability provided by the stitch work through the apertures 350 in the upper portion 310 of the lace clip 300 can also be provided by a clamp, adhesives, or a combination of magnets. The primary considerations for what method to use are manufacturing costs and structural integrity. For example, a simple coat of adhesive will reduce manufacturing costs and degrade the strength of the connection between the sleeve and the shoe. Alternatively, a system of magnets will significantly increase manufacturing costs and increase the strength of the connection between the sleeve and the shoe.

Figure 4C:
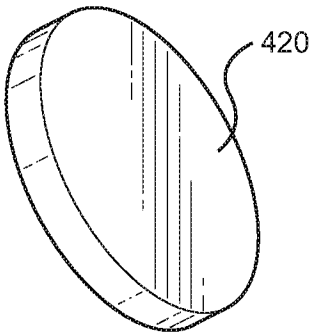
FIG. 4C shows a perspective of a third weight configured to be inserted into a third compartment on the front end of an embodiment of a shoe weight for athletic training.
Figure 4B:
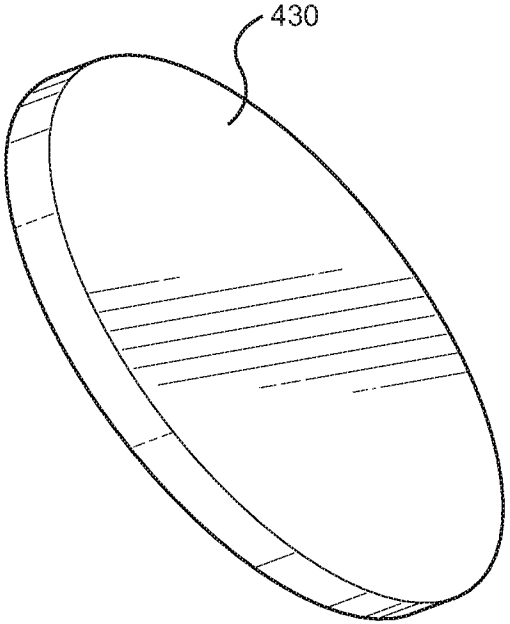
FIG. 4B shows a perspective view of a second weight configured to be inserted into a second compartment on the right side of an embodiment of a shoe weight for athletic training.
Figure 4A:
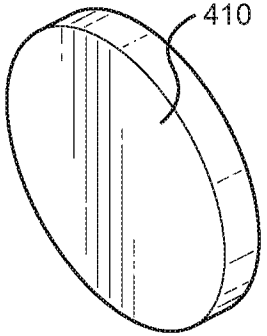
FIG. 4A shows a perspective view of a first weight configured to be inserted into a first compartment on the left side of an embodiment of a shoe weight for athletic training.

Referring now to FIGS. 4A, 4B, and 4C, there are shown perspective views of a first weight configured to be inserted into a first compartment on the left side, a second weight configured to be inserted into a second compartment on the right side, and a third weight configured to be inserted into a third compartment on the front end of an embodiment of a shoe weight for athletic training, respectively. In the illustrated embodiment, the weights 410, 420, 430 are configured to be permanently secured within the first, second, and third compartments respectively. In other embodiments, the weights 410, 420, 430 can vary in size and are configured to be removably inserted, such that the user can increase or decrease the load in each compartment according to their specific preferences. The front weight 430 is larger and heavier than the side weights 410, 420 to increase the stability of the shoe weight when worn. To avoid interfering with the user's center of gravity while wearing the device and exercising the majority of the weight is housed in the front compartment of the sleeve, such that the weight 430 rests laterally on top of the shoe. This configuration more evenly distributes the weight over a broader surface area focused around the center portion of the shoe rather than placing too much weight on either the left side or the right side of the shoe. Thereby reducing the likelihood of injury due to trips, or falls caused by unbalanced weight distribution.

Figure 5A:
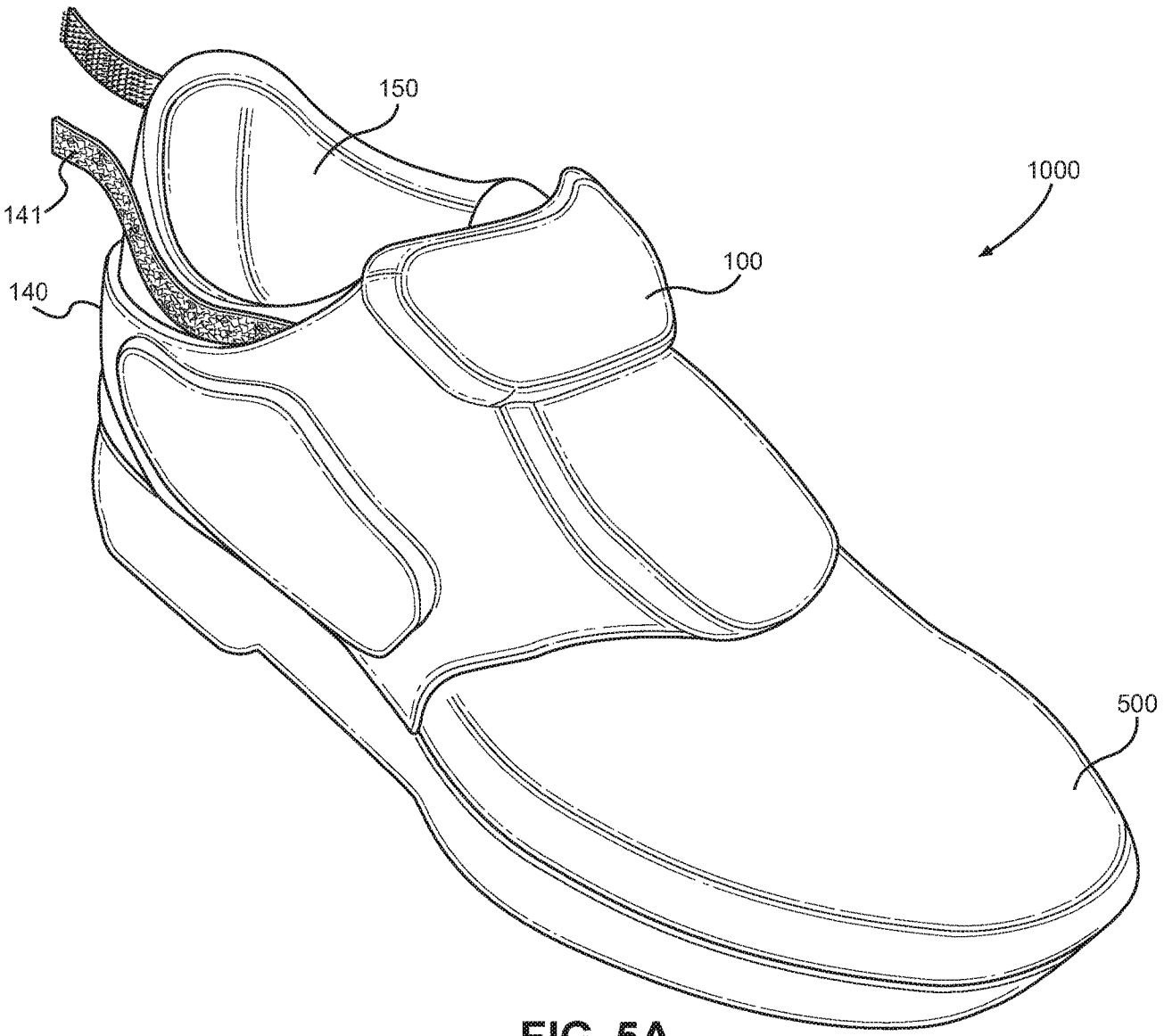
FIG. 5A shows a perspective view of an embodiment of a shoe weight for athletic training including an adjustable strap, as worn on a shoe.

Referring now to FIG. 5 there is shown a perspective view of an embodiment of a shoe weight for athletic training including an adjustable strap, as worn on a shoe. In this alternate embodiment, the top end 140 of the sleeve 100 further includes an adjustable strap 141 configured to vary the size of the aperture 150. In this way, the size of the aperture 150 can be adjusted to accommodate various sizes and styles of shoe 500, allowing a user to attach the sleeve 100 to any shoe 500. This serves to reduce cost to the user as only a single set of removeable shoe weights 1000 must be purchased to accommodate a user's entire wardrobe.

Figure 5B:
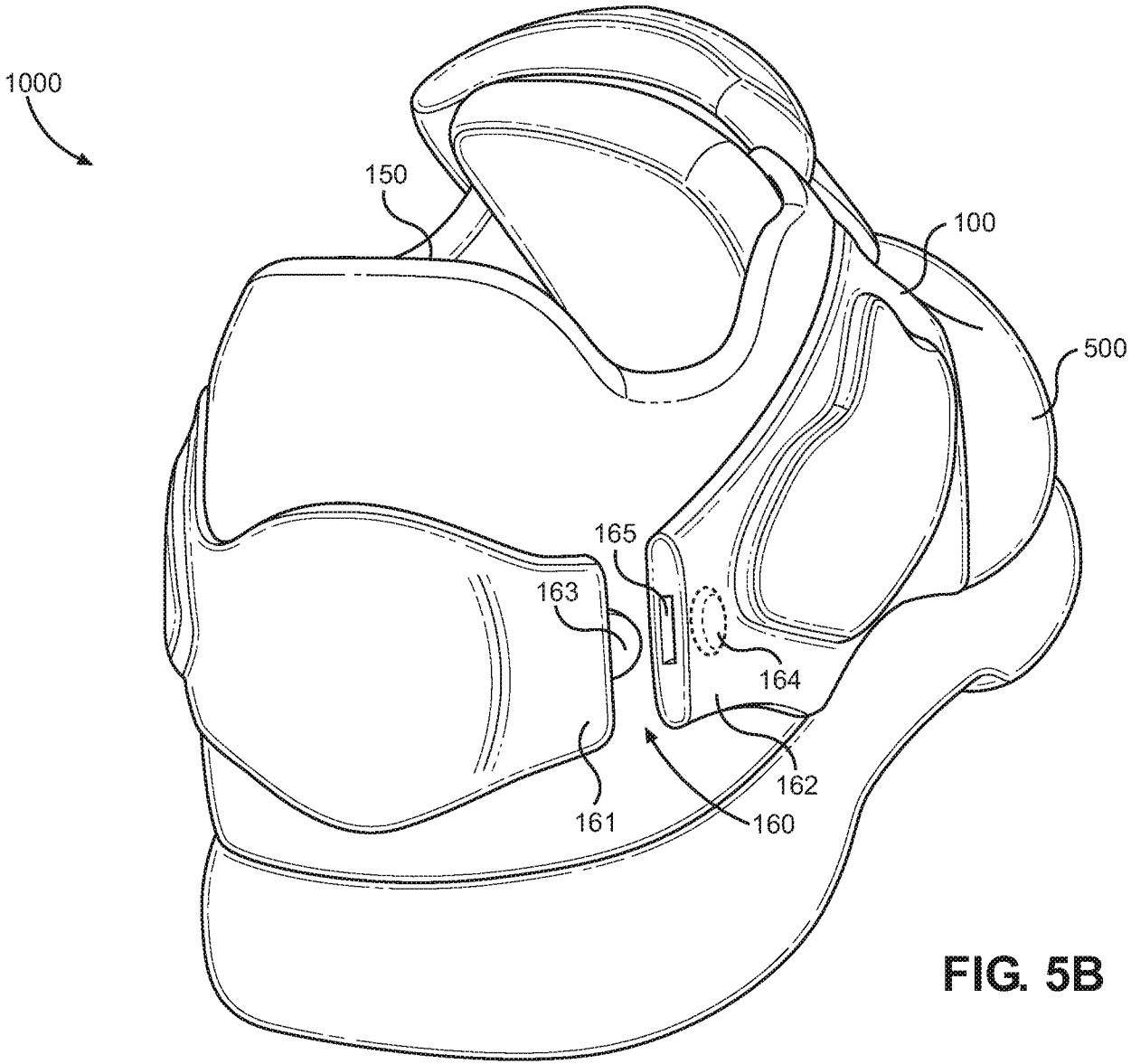
FIG. 5B shows a perspective view of an embodiment of a shoe weight for athletic training including a latching mechanism in the open position, as worn on a shoe.
Figure 5C:
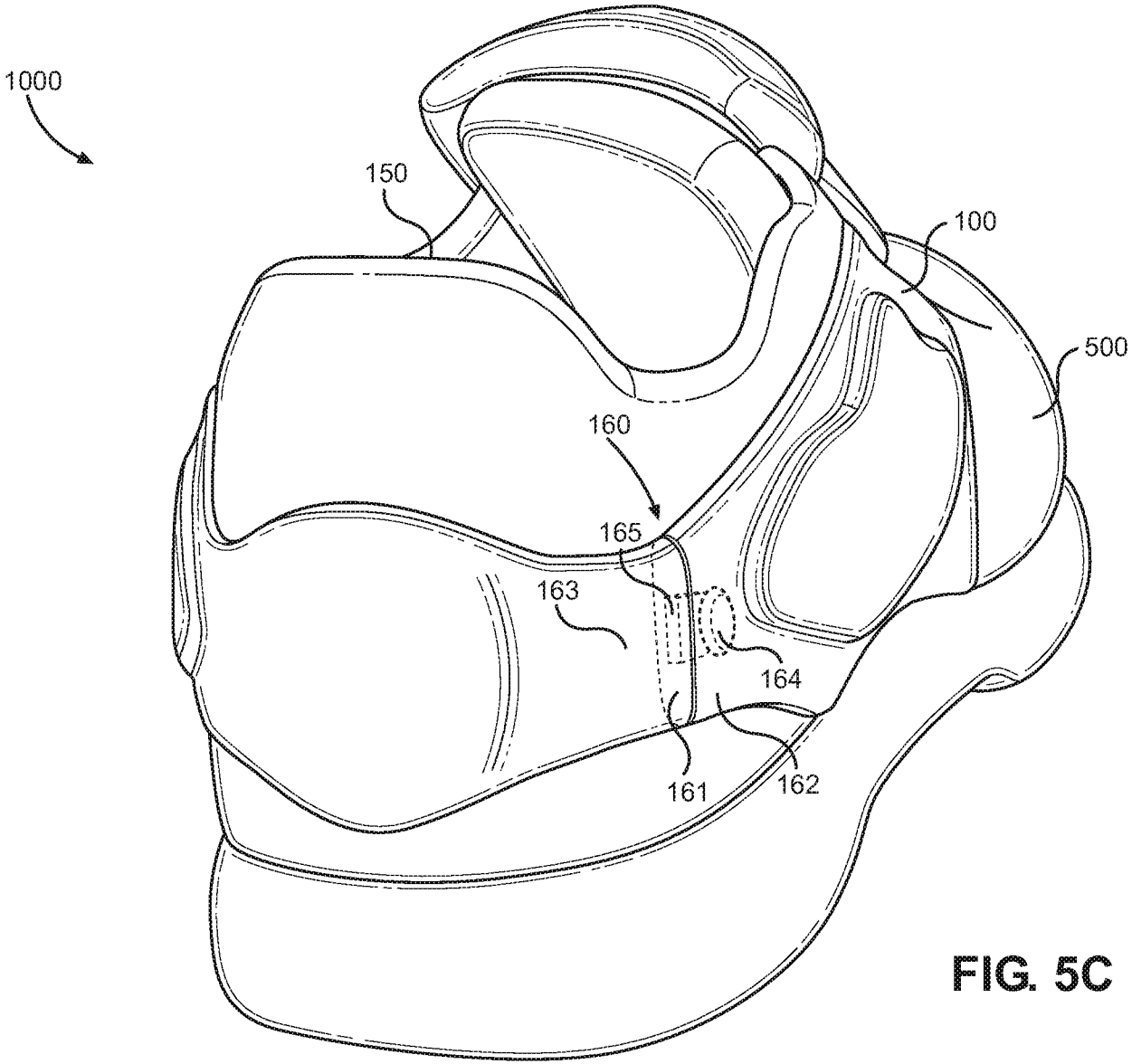
FIG. 5C shows a perspective view of an embodiment of a shoe weight for athletic training including a latching mechanism in the closed position, as worn on a shoe.

Referring now to FIGS. 5B and 5C there are shown perspective views of an embodiment of a shoe weight for athletic training including a latching mechanism in the open position, and in the closed position respectively, as worn on a shoe. In yet another embodiment, the sleeve 100 includes a latching mechanism 160 configured to open and close around the shoe 500 being worn underneath the shoe weight for athletic training 1000. This open and close functionality allows a user to put on the shoe weight for athletic training 1000 without having to first take off their shoe and reinsert their feet through the aperture 150. The latching mechanism comprises an insertable male end 163 disposed on a first end 161, and a female end 164 disposed within a second end 162. To close the latching mechanism 160 the insertable male end 163 is inserted through a slot 165 disposed on the second end 162 and into the female end 164, such that the first end 161 and the second end 162 are securely joined together. To open the latching mechanism 160 a user must press down on the female end 164, which is configured to release the insertable male end 163 upon compression.

In other embodiments the adjustable strap 141 in FIG. 5 is combined with the latching mechanism 160 to create an adjustable shoe weight 1000 with open and close functionality.

It is therefore submitted that the instant invention has been shown and described in what s considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact constriction and operation shown and described, and accordingly, all suitable modifications and equivalents may be resorted to, falling within the scope of the invention.

I claim:

1. A shoe weight for athletic training, comprising:

a shoe sleeve having a left side, a right side, a front end, and a top end, configured to rest upon the outer surface of a shoe while being worn;

wherein the top end includes an aperture sized and proportioned for a foot to pass therethrough, such that the foot is inserted into the shoe being worn;

wherein the shoe sleeve further includes an adjustable hook and loop strap configured to vary the size of the aperture;

a flexible U-shaped member disposed within the shoe sleeve configured to exert an inward force against the outer surface of the shoe being worn, such that the shoe sleeve is held in place against the surface of the shoe;

wherein the U-shaped member further includes a left arm and a right arm, such that the left arm is configured to press against a left side of the shoe being worn, and the right arm is configured to press against a right side of the shoe being worn;

and wherein a first pressure pad is disposed on a first end of the left arm of the U-shaped member to enlarge the area of pressure applied to the left side of the shoe, and a second pressure pad is disposed on a second end of the right arm of the U-shaped member to enlarge the area of pressure applied to the right side of the shoe;

a portion of a lace clip is sized and proportioned to slide in between the laces and the tongue of the shoe, and a point of inflection and an upper portion hook the shoe sleeve to the shoe;

a plurality of weights disposed within the shoe sleeve, such that the wearer of the shoe is forced to expend greater energy while walking, running, or performing any act involving movement of the foot inserted in the shoe being worn.

2. The shoe weight according to claim 1, wherein the shoe sleeve further includes a first compartment disposed on the left side, a second compartment disposed on the right side, and a third compartment disposed on the front end.

3. The shoe weight according to claim 2, wherein the first compartment is configured to receive and house a first weight therein, the second compartment is configured to receive and house a second weight therein, and the third compartment is configured to receive and house a third weight therein.

4. The shoe weight according to claim 3, wherein the first weight rests securely within the first compartment on the left side of the shoe, the second weight rests securely within the second compartment on the right side of the shoe, and the third weight rests securely within the third compartment on the front end of the shoe.

5. The shoe weight according to claim 4, wherein the first weight is removably inserted in the first compartment, the second weight is removably inserted in the second compartment, and the third weight is removably inserted in the third compartment.

6. The shoe weight according to claim 1, wherein a plurality of apertures disposed on the upper portion of the lace clip are configured to allow stitch work therethrough to permanently secure the lace clip to the shoe sleeve.

7. The shoe weight according to claim 1, wherein the shoe sleeve further includes a latching mechanism configured to provide open and close functionality.

8. The shoe weight according to claim 7, wherein the latching mechanism comprises an insertable male end disposed on a first end, a slot disposed on a second end and female end disposed within the second end.

9. The shoe weight according to claim 8, wherein the male end is configured to be inserted through the slot and to removably interconnect with the female end, and the female end is configured to receive and to removably interconnect with the male end when inserted such that the first and second ends are securely joined together.

10. The shoe weight according to claim 9, wherein the female end of the latching mechanism is configured to release the insertable male end when compressed.

11. The shoe weight according to claim 10, wherein the male end of the latching mechanism is disposed on an adjustable strap configured to vary the size of the aperture.

* * * * *